United States Patent [19]

Lindqvist et al.

[11] 4,196,235

[45] Apr. 1, 1980

[54] METHODS AND APPARATUS FOR SPREADING SEMI-LIQUID COMPOSITIONS ON A BASE SURFACE

[76] Inventors: Bengt-Erik Lindqvist, Korpralsvägen 7B, 90253 Umeå; Harald K. Spetz, Floda, 91039 Botsmark, both of Sweden, 91039

[21] Appl. No.: 832,282

[22] Filed: Sep. 12, 1977

[51] Int. Cl.[2] ..... B05D 3/12

[52] U.S. Cl. ..... 427/356; 427/355; 404/119; 15/104 S; 425/458; 425/87; 118/102; 118/100

[58] Field of Search ..... 118/102, 100; 15/104 S; 425/458, 87; 427/355, 356, 358; 404/119, 118

[56] References Cited

U.S. PATENT DOCUMENTS

| | | | |
|---|---|---|---|
| 910,073 | 1/1909 | Lischke | 404/119 |
| 3,901,618 | 8/1975 | Sant Agata | 404/118 |
| 3,947,916 | 4/1976 | Mitchel | 425/458 |

FOREIGN PATENT DOCUMENTS

| | | | |
|---|---|---|---|
| 78783 | 12/1949 | Norway | 404/118 |

*Primary Examiner*—Sam Silverberg
*Attorney, Agent, or Firm*—Fitch, Even & Tabin

[57] ABSTRACT

A plate having a long handle attached thereto is used for spreading a semi-liquid composition over a base surface, the thickness of the layer being determined by a supporting spherical wheel. Another plate having a long handle is used for leveling the surface of the composition which is spread according to a pattern of juxtaposed strips.

3 Claims, 6 Drawing Figures

1
2
3a
3b
4
5a
5b
6
7
8
9
10a
10b
11
12
13
14
15
16
17
30

METHODS AND APPARATUS FOR SPREADING SEMI-LIQUID COMPOSITIONS ON A BASE SURFACE

This invention relates to a method for spreading over a base surface strips of a semi-liquid plastic composition or mass forming a uniformly thick layer. The invention has also for its object to provide apparatus for carrying out this method.

The priorly known methods of spreading plastic compositions for running tracks and the like have been performed altogether manually, by way of conventional leveling employing water-levels and the like.

Such methods are rather time-consuming and require highly skilled workers for spreading the composition and finishing the surface.

It is, therefore, an object of the invention to provide novel method and apparatus which do not require skilled personnel for their use.

A further object is to render a better working posture possible for the persons carrying out the labor.

A still further object is to increase the speed of the spreading process.

These and other objects of the invention will become obvious from the specification and the annexed drawings.

In the drawings

Figures 1, 2:
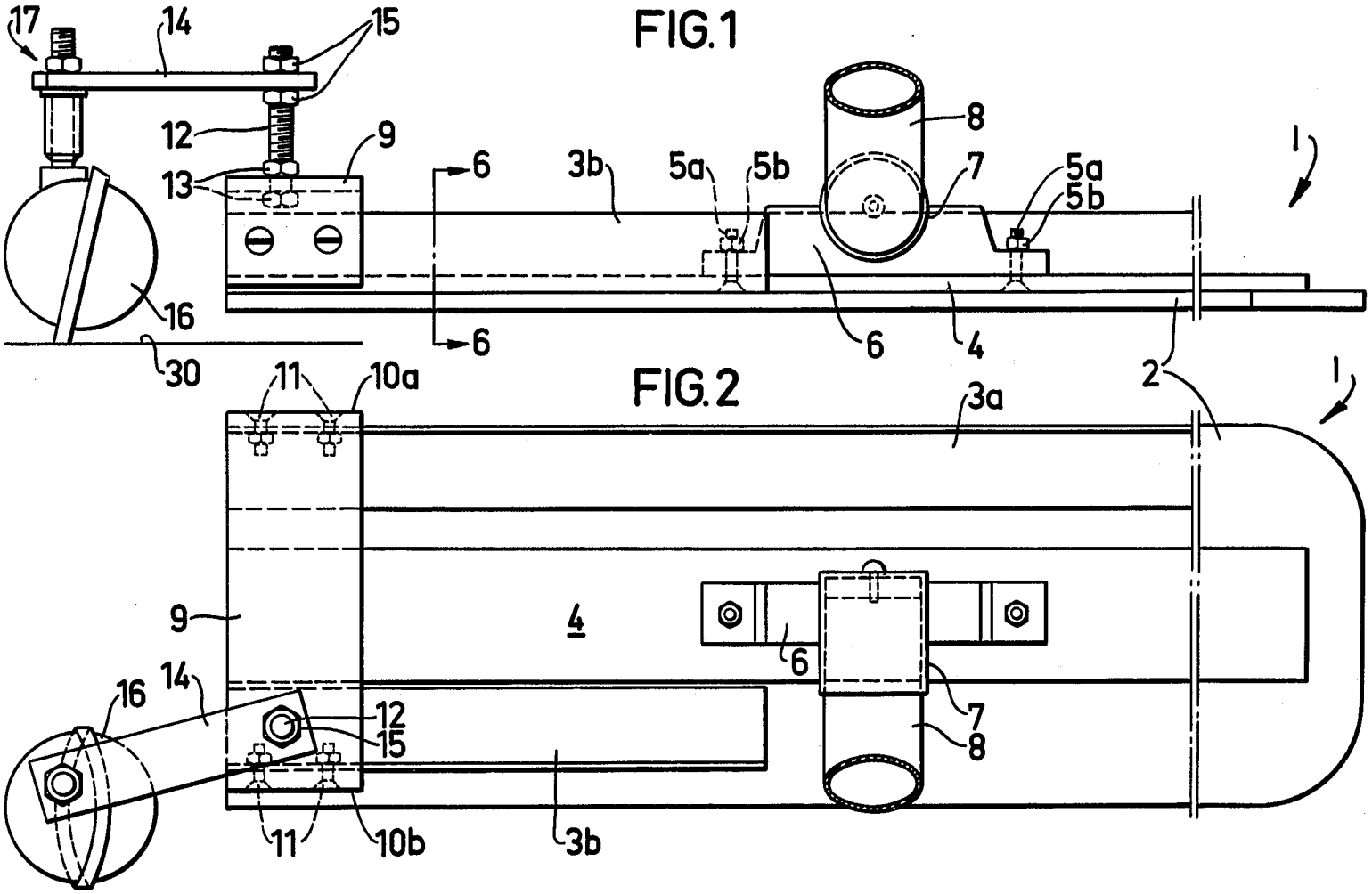
FIG. 1 is an elevation view of a spreading implement.
FIG. 2 is a plan view of the spreading implement in FIG. 1.

The spreading implement 1 illustrated in FIGS. 1 and 2 comprises a smooth planar glass plate 2 having a rather great length to width ratio. To the glass plate 2 two angle members 3*a* and 3*b* preferably of aluminium are attached or bonded. The angle member 3*a* has its upstanding flange level with the front or leading edge of the glass plate 2 in the direction of travel (as explained below). The angle member 3*a* extends substantially along the full length of the glass plate 2. The angle member 3*b* extends to the left end of the glass plate 2 (FIGS. 1 and 2). This angle member is shorter than angle member 3*a* and it is spaced some distance from the rear or trailing edge of the glass plate 2.

Figure 5:
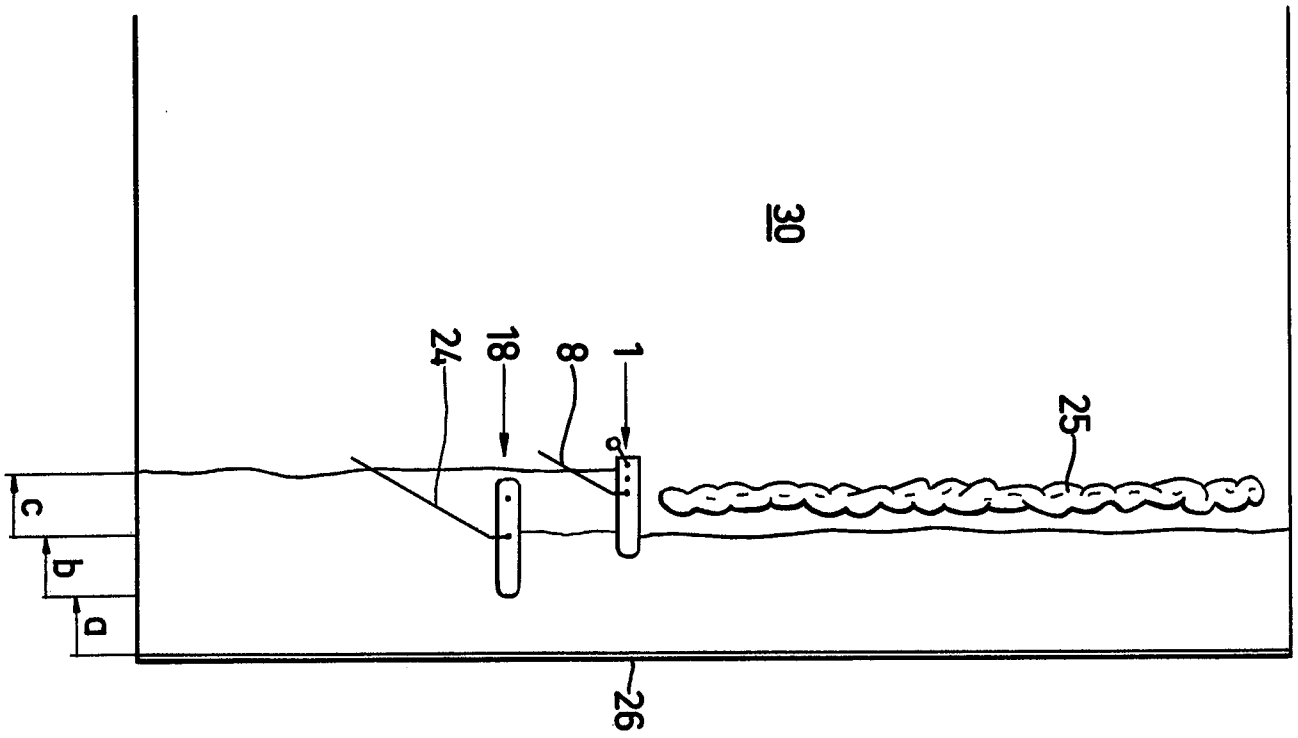
FIG. 5 is a diagrammatic view illustrating the different steps of the surfacing method.
Figure 6:
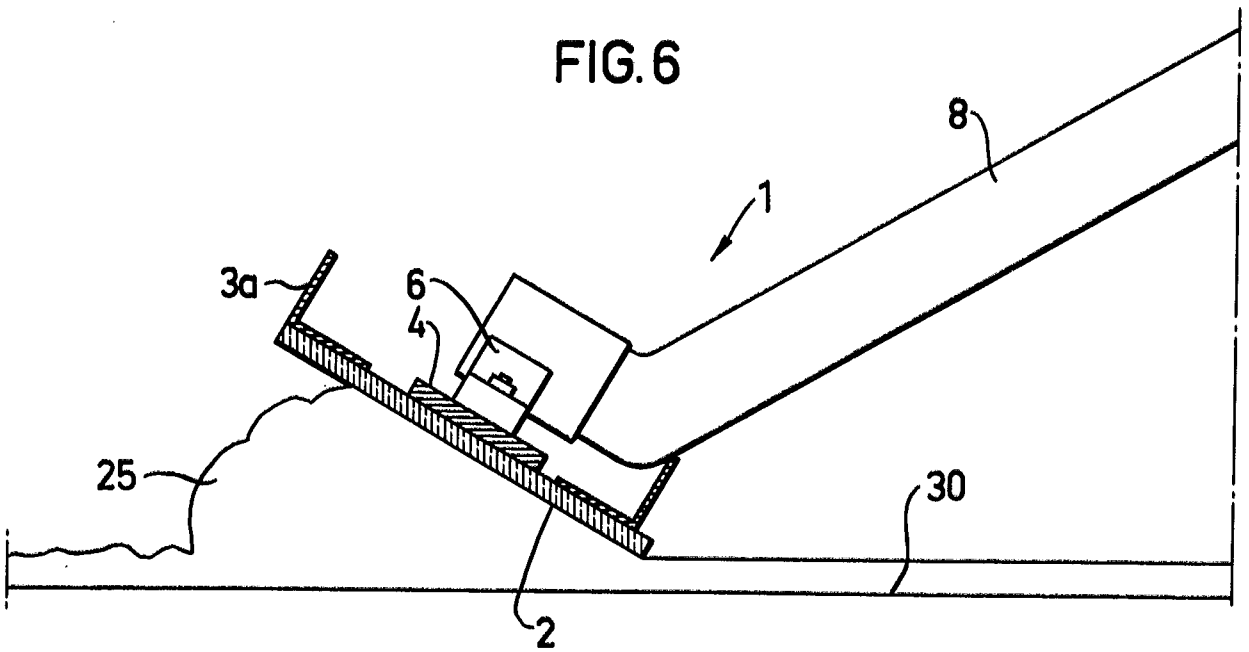
FIG. 6 is a diagrammatic section along 6—6 in FIG. 1 of the spreading implement in operating position.

Between the two angle members 3*a*, 3*b* there is secured to plate 2 a support plate 4 extending longitudinally of the glass plate 2. To this support plate 4 a bracket member 6 is attached as by screws and nuts 5*a*, 5*b*, respectively. This bracket member 6 is preferably made of aluminium and has secured thereto a sleeve 7 for receiving one end of a pipe 8 inclined to the horizontal plane and terminated by an operating handle (FIGS. 5 and 6).

As seen from FIG. 1 the screws 5*a* are countersunk from below into the support plate 4 and pass therethrough and further through the material of the bracket member 6 and are locked by means of the nuts 5*b* at the upper side of the bracket member 6.

The sleeve 7 is pivotally attached to bracket member 6 so as to be capable of being tilted about an axis normal to the longitudinal dimension of the glass plate 2. By virtue of this arrangement the pipe 8 can be inclined more or less relative to a vertical plane as well as assuming a position which is more or less offset in the lateral direction, owing to the pipe 8 being bent angularly near its attachment in sleeve 7.

At the left extremity of the glass plate 2 (FIGS. 1 and 2) the angle members 3*a* and 3*b* are bridged by a U-shaped bail member 9, the legs 10*a* and 10*b* of which extend downwards. By means of suitable fixing members such as screws 11 and nuts the legs 10*a* and 10*b* are secured to the angle members 3*a* and 3*b*.

Adjacent to the bail member leg 10*b* located at the rear edge of the glass plate 2 there is provided a screw-threaded clamping bolt 12 extending substantially perpendicularly to the glass plate 2. The clamping bolt 12 is rigidly secured to bail member 9 by its lower end by means of nuts 13, and it supports at its top end a laterally extending arm member 14 rigidly secured to the bolt 12 by clamping nuts 15. These nuts can be set in a higher or lower position on bolt 12 whereby the spacing between the glass plate 2 and the base surface 30 can be adjusted. At its end distant from the bolt 12 the arm 14 carries a pivoted spherical wheel 16 by means of a suitable rigid connection 17.

As seen from FIG. 2 the spherical wheel 16 is set in such a position relative to the glass plate 2 that a plane passing through the rear edge of the glass plate 2 and perpendicular to the latter will also pass through the pivot axis of the spherical wheel 16.

Figure 3:
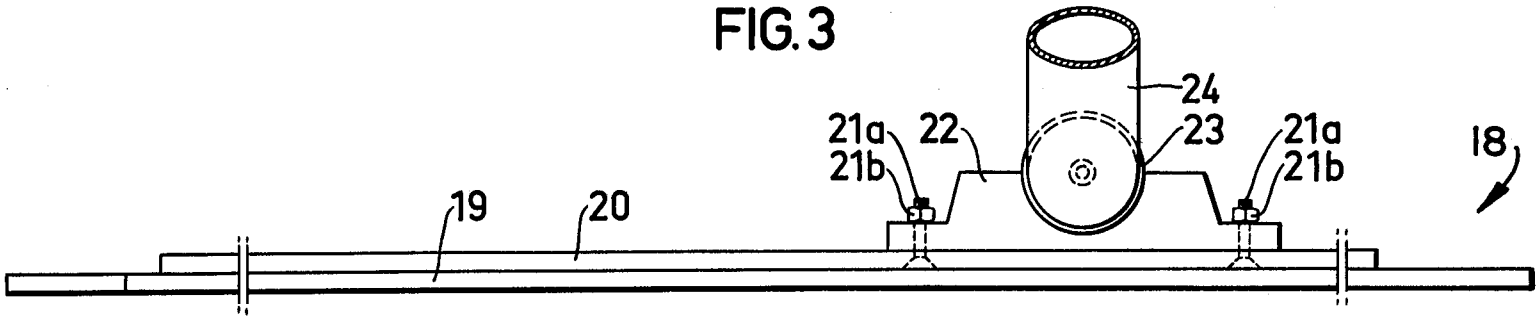
FIG. 3 is an elevation view of a leveling implement.
Figure 4:
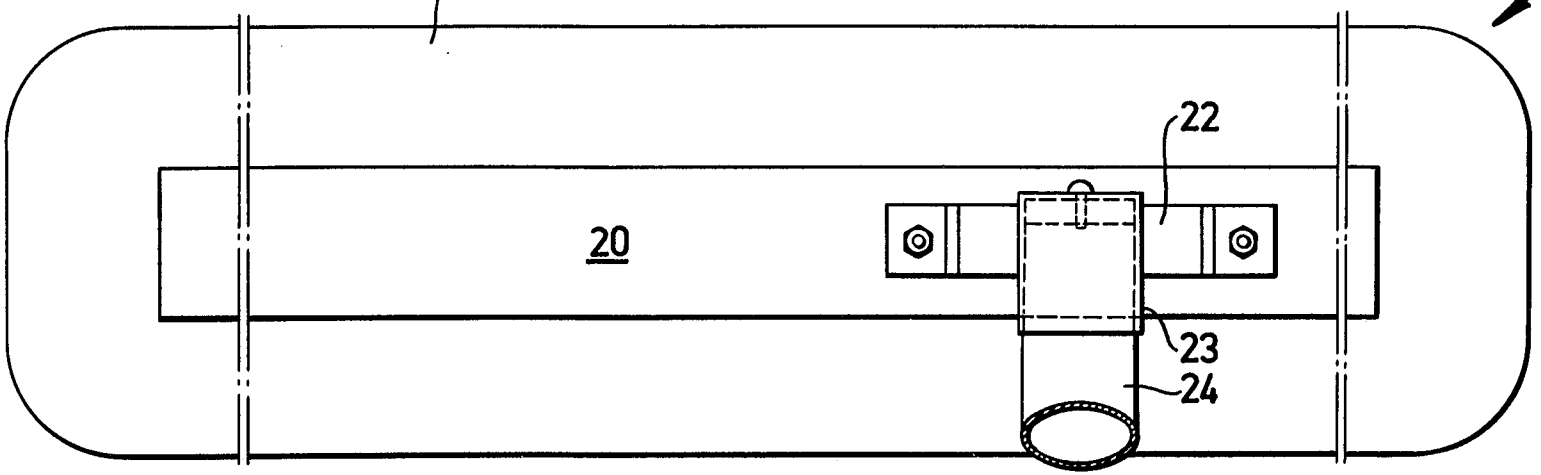
FIG. 4 is a plan view of the leveling implement in FIG. 3.

FIGS. 3 and 4 illustrate an embodiment of a leveling implement 18 according to the invention. Upon a smooth planar glass plate 19 a base plate 20 of aluminium is superposed and preferably bonded to the glass plate 19. A bracket member 22 is secured to the base plate 20 by means of screws and nuts 21*a* and 21*b*, respectively. This bracket member 22 is preferably made of aluminium and carries a sleeve 23 receiving a pipe 24 inclined relative to the glass plate 19 and terminated by an operating handle (FIG. 5). As in the spreading implement 1 the screws 21*a* are countersunk from below in the base plate 20 and pass through the latter and the bracket member 22 and are secured by nuts 21*b* on the upper side of bracket member 22.

The sleeve 23 has a similar connection to its bracket member 22 as sleeve 7 formerly described and is thus pivoted for tilting movement in the longitudinal sense of the leveling implement. By being angularly bent near its attachment to the sleeve 23 the position of its handle can be varied both as to height and laterally.

The spreading and leveling of composition will now be described with reference to FIG. 5.

When spreading the first strip an appropriate volume of composition 25 is laid on the base surface 30 as illustrated for the still unspread portion of strip c, along a lath 26 extending along a side of the whole area to be surfaced. The lath 26 stands proud of the base surface to a height corresponding to the thickness of the composition layer to be applied. When spreading the first strip a the right hand edge of the spreading implement 1 will engage the top of the lath 25. When spreading subsequent strips the right hand edge of the spreading implement 1 will engage the adjacent strip, already leveled.

By adjusting the height of the arm 14 by turning the nuts 15 engaging the bolt 12 the spacing between the base surface 30 to receive a composition layer and the left hand end of the spreading implement can be set according to the height of the lath 26 above the base surface 30.

On advancing the spreading implement 1 during operation it is advantageous to tilt the leading edge of the glass plate 2 upwards by means of the pipe 8 and the operating handle (FIG. 6) thereby displacing surplus composition 25 forwards by means of the glass plate 2. It is preferable, therefore, that the adjustment of the height of the left end of the implement (FIG. 5) be carried out after that the glass plate has assumed the desired oblique position. When advancing the spreading implement there will, of course, occur a certain variation of the inclined position of the glass plate 2 depending on the height above the base surface of the operating handle. This height variation may depend on the length of time required for the operation and also on an accustomed working posture. As a rule, the handle will not deviate more than about ±2.5 inches from the initial position, however. Due to the relatively great length of the pipe 8 and the manner of supporting the spherical wheel 16 this will entail a variation at surface level which is insignificant in practice. The internationally accepted tolerances of ±2 millimeters (±0.08 in) are readily complied with.

The pivoted attachment of the sleeves 7 and 23 makes a laterally offset position of the operating pipes 8 and 24 possible (FIG. 5) whereby a person pushing the implement forwards need not tread on the composition already spread and leveled.

As best seen from FIG. 6 the spreading implement 1 which carries at its leading edge the angle member 3*a* with one flange upstanding perpendicularly to the glass plate 2 will push surplus composition which may rise above the leading edge of the glass plate 2 forwards by means of the upstanding flange. When a strip has been spread by means of the spreading implement adjacent to a strip already finished the leveling implement 18 is advanced with its middle portion above the area of the joint between the both strips such as strips b and c in FIG. 5. Thereby the seam line between the strips will be leveled off and will become invisible, and the surface of the newly spread composition will be leveled as a whole, as well. The use of glass as material for the plates 2 and 19 has been found advantageous, one reason therefor being that adhesion between the semi-liquid composition and a glass plate will be low.

Spreading and leveling of successive strips is continued until the whole required area has been surfaced.

The implements described and illustrated enable spreading and leveling of a composition to be carried out in a very simple manner and with an excellent result. They are only to be taken as examples, however, and can be varied and modified in many respects within the scope of the appended claims.

What we claim is:

1. A method of spreading a pattern of juxtaposed strips of a semi-liquid plastic composition to form a layer of uniform thickness on a base surface comprising the steps of feeding out the composition as a string for each strip;

spreading said string by means of an implement which includes a planar surface in the form of a plate, means attached to one end of the plate for abutment against said base surface and advancement therealong, means secured to said plate and pivotable about an axis perpendicular to the longitudinal dimension of said plate for connecting an elongated operating bar to said plate, and an elongated operating bar received by said connecting means; and leveling the composition in the area of the joints between strips by means of an implement which includes a planar surface in the form of a plate, means secured to said plate and pivotable about an axis perpendicular to the longitudinal dimension of said plate for connecting an elongated operating bar to said plate, and an elongated operating bar received by said connecting means.

2. A method according to claim 1 wherein each string of semi-liquid plastic composition is spread to form a layer having a substantially uniform width.

3. A method according to claim 1 wherein the spreading implement includes means for raising its leading edge at a higher level than its trailing edge in the operative position and wherein said means for abutment is adjustable in height to maintain the trailing edge at a distance above the base surface equal to the thickness of the spread-out composition.

* * * * *